US010418166B2

(12) United States Patent
Kuo et al.

(10) Patent No.: US 10,418,166 B2
(45) Date of Patent: Sep. 17, 2019

(54) NONE-COUPLING DUAL INDUCTOR

(71) Applicant: ITG ELECTRONICS, INC., New Taipei (TW)

(72) Inventors: Martin Kuo, New Taipei (TW); Nanhai Zhu, New Taipei (TW)

(73) Assignee: ITG ELECTRONICS, INC., New Taipei (TW)

( * ) Notice: Subject to any disclaimer, the term of this patent is extended or adjusted under 35 U.S.C. 154(b) by 217 days.

(21) Appl. No.: 15/625,922

(22) Filed: Jun. 16, 2017

(65) Prior Publication Data

US 2018/0366256 A1 Dec. 20, 2018

(51) Int. Cl.

| | |
|---|---|
| ***H01F 27/24*** | (2006.01) |
| ***H01F 27/28*** | (2006.01) |
| ***H01F 1/34*** | (2006.01) |
| ***H01F 3/10*** | (2006.01) |
| ***H01F 27/38*** | (2006.01) |
| *H01F 27/29* | (2006.01) |

(52) U.S. Cl.

CPC ..... *H01F 27/2847* (2013.01); *H01F 1/34* (2013.01); *H01F 3/10* (2013.01); *H01F 27/24* (2013.01); *H01F 27/38* (2013.01); *H01F 27/29* (2013.01)

(58) Field of Classification Search

CPC ..... H01F 27/00–36

USPC .... 336/65, 83, 192, 200, 220–223, 232–234

See application file for complete search history.

(56) References Cited

U.S. PATENT DOCUMENTS

| | | | | |
|---|---|---|---|---|
| 9,842,682 | B2 * | 12/2017 | Yan | H01F 27/263 |
| 2012/0056704 | A1 * | 3/2012 | Nagano | H01F 27/38 336/170 |
| 2012/0062349 | A1 * | 3/2012 | Nagano | H01F 27/263 336/212 |
| 2014/0085035 | A1 * | 3/2014 | Kim | H01F 27/38 336/212 |

* cited by examiner

*Primary Examiner* — Tuyen T Nguyen

(74) *Attorney, Agent, or Firm* — Intellectual Property Law Group LLP

(57) ABSTRACT

A none-coupling dual inductor is provided, including a main iron core body having a middle bump, a plurality of subsidiary iron core bodies respectively disposed corresponding to two sides of the main iron core body, a plurality of metal sheet coils respectively disposed between the two sides of the main iron core body and the plurality of subsidiary iron core bodies, and a plurality of plate bodies respectively disposed between the main iron core body and the plurality of metal sheet coils and the plurality of subsidiary iron core bodies. The none-coupling dual inductor shares the middle bump of the main iron core body to be integrally formed so as to save space and increase power density. Even if the magnetic circuits of two inductors have a significant difference in the magnetic resistance, the none-coupling dual inductor of the present disclosure can still have a low coupling coefficient.

9 Claims, 4 Drawing Sheets

NONE-COUPLING DUAL INDUCTOR

BACKGROUND

1. Technical Field

The present disclosure relates to a none-coupling dual inductor, in particular, to a none-coupling dual inductor having a low coupling coefficient and capable of saving space and increasing power density.

2. Description of Related Art

In the existing technology, the purpose of achieving high power density and high efficiency in terms of power supply products or power modules is a never-changing topic, that is, a development trend in the future. This puts forward higher requirements for giving power supply products indispensable power inductors and how to minimize the size in order to achieve high power density.

Basically, conventional inductor elements are constructed separately in which single elements are mainly used. A very few of conventional inductor elements is integrated with plural inductors for structural applications. The existing dual inductor elements are mostly composed of the coupling dual inductor having numerous coils of the same magnetic circuit. Even though integrating single inductors can obtain a dual inductor, such a manner needs large space, which does not make much progress and contribution to the space savings and power density. Therefore, there is still room for improvement in terms of conventional inductor elements.

SUMMARY

The primary purpose of the present disclosure is to provide a none-coupling dual inductor aiming at overcoming the aforementioned drawbacks. The none-coupling dual inductor has the following advantages that the element structure is formed by a none-coupling manner which means that two inductors can be applied independently without interfering with each other, and can effectively save space and reduce the entire size. By means of a better magnetic circuit structure, the none-coupling dual inductor of the present disclosure is capable of working independently without causing any negative influence. In addition, in the structure of the none-coupling dual inductor, an I-shaped iron core body can be integrated with other component materials to form a dual inductor, so that the size can be reduced and the space can be saved effectively, thereby improving the operation efficiency of the product.

For the sake of achieving the aforementioned purposes, the present disclosure provides a none-coupling dual inductor, including: a main iron core body having a middle bump; a plurality of subsidiary iron core bodies respectively disposed corresponding to two sides of the main iron core body; a plurality of metal sheet coils respectively disposed between the two sides of the main iron core body and the plurality of subsidiary iron core bodies; and a plurality of plate bodies respectively disposed between the main iron core body and the plurality of metal sheet coils and the plurality of subsidiary iron core bodies. The middle bump of the main iron core body can be connected to the plurality of subsidiary iron core bodies and the plurality of metal sheet coils respectively disposed at the two sides of the main iron core body to form a plurality of inductors, and the plurality of plate bodies can control air gaps between the main iron core body and the plurality of subsidiary iron core bodies to obtain the desired inductance.

Moreover, the main iron core body can be an I-shaped iron core body. The plurality of subsidiary iron core bodies include a right side iron core body and a left side iron core body, and the right side iron core body and the left side iron core body can be an I-shaped iron core body or a T-shaped iron core body transformed from an I-shaped iron core body. The plurality metal sheet coils include a right side metal sheet coil and a left side metal sheet coil, and the right side metal sheet coil and the left side metal sheet coil can be an N-shaped or a C-shaped metal sheet coil. The right side iron core body and the left side iron core body can be respectively disposed at two sides of the main iron core body, and a right side plate body and a left side plate body can be respectively disposed therebetween to form air gaps so as to achieve an integral none-coupling dual inductor.

To sum up, by means of a farther distance between two air gaps, the present disclose can reduce the coupling degree of two inductors caused by the electromagnetic radiation to the most extent. Even if the magnetic circuits of two inductors have a significant difference in the magnetic resistance, the none-coupling dual inductor of the present disclosure can still have a low coupling coefficient. In addition, the none-coupling dual inductor shares the middle bump of the main iron core body which is an I-shaped iron core body, so that the entire device is integrally formed to save space and increase power density.

DESCRIPTION OF THE EXEMPLARY EMBODIMENTS

The present disclosure provides a none-coupling dual inductor which achieves a low coupling coefficient between two inductors without interfering with each other by means of a better magnetic circuit design. In addition, the none-coupling dual inductor provided by the present disclosure has the advantage of reducing the size and saving the space compared with its conventional counterparts.

It will hereinafter be more fully with reference to various illustrative embodiments, the accompanying drawings showing some embodiments in the accompanying exemplary embodiments shown in the accompanying drawings described. However, the concept of the present invention may be embodied in many different forms and should not be construed as limited to the embodiments set forth herein illustrated exemplary embodiment. Rather, these exemplary embodiments provide that the embodiments of the present disclosure will be thorough and complete, and will skilled in the art will fully convey the scope of the inventive concept. In the accompanying drawings, the size may be exaggerated for clarity and illustrating the layer and the relative sizes of regions. Similar numerals refer to similar components.

It should be understood, it may be used herein, although the terms left side, right side, middle, main, subsidiary, plate etc., to describe various components, but these components should not be affected by such terms. The term is used to distinguish such an assembly with another component. Thus, the left side component may be discussed hereinafter referred to as the right side component without departing from the teachings of the present concept of the utility model. As used herein, the term "and/or" includes any and all combinations of one or more of the associated listed items. In addition, the term of plurality may be used herein to describe a plurality of elements, but such plural elements are not limited to two, three or four, or more than four elements for representing the implementation of the technology, it is for illustrative purposes only and does not represent the only embodiments.

Figure 1:
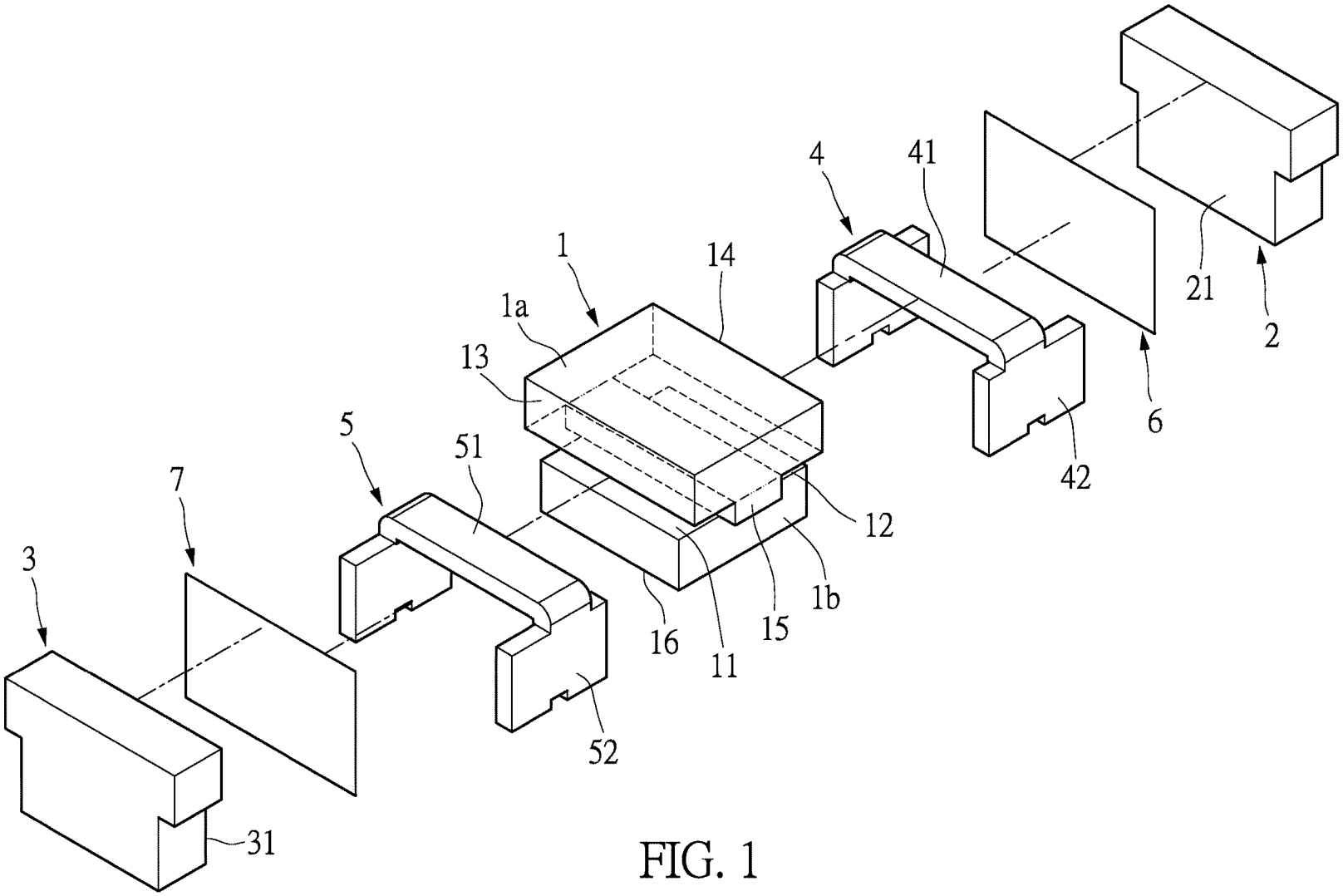
FIG. 1 is an exploded view of an embodiment of the present disclosure.

Reference is made to FIG. 1. A none-coupling dual inductor provided by the present disclosure includes a main iron core body 1 (e.g. an I-shaped main iron core body), a plurality of subsidiary iron core bodies (e.g. a right side iron core body 3 and a left side iron core body 2), a plurality of metal sheet coils (e.g. a right side metal sheet coil 5 and a left side metal sheet coil 4) and a plurality of plate bodies (e.g. a right side plate body 7 and a left side plate body 6). Moreover, the main iron core body 1 includes a middle bump 15, the plurality of subsidiary iron core bodies are respectively disposed corresponding to two sides of the main iron core body 1, the plurality of metal sheet coils are respectively disposed between the two sides of the main iron core body 1 and the plurality of subsidiary iron core bodies, and the plurality of plate bodies are respectively disposed between the main iron core body 1 and the plurality of metal sheet coils and the plurality of subsidiary iron core bodies; wherein the middle bump 15 of the main iron core body 1 is connected to the plurality of subsidiary iron core bodies and the plurality of metal sheet coils respectively disposed at the two sides of the main iron core body 1 to form a plurality of inductive components. In practice, the plurality of inductive components can be a first inductor and a second inductor. The none-coupling dual inductor provided by the present disclosure controls air gaps between the main iron core body and the plurality of subsidiary iron core bodies through the plurality of plate bodies to obtain the desired inductance so as to achieve the none-coupling dual inductor.

For further understating the connection relation, the following paragraphs will describe the structure and combination of the above-mentioned elements.

The element structure of the present disclosure is described as follows.

Referring to FIG. 1, the main iron core body 1 includes an upper iron core body 1*a*, a lower iron core body 1*b*, a right side accommodating space 11, a left side accommodating space 12, a right side assembling plane 13, a left side assembling plane 14, a middle bump 15, and a bottom surface 16. The plurality of subsidiary iron core bodies include a right side iron core body 3 and a left side iron core body 2, and the right side iron core body 3 has an assembling surface 31 and the left side iron core body 2 has an assembling surface 21. In practice, the main iron core body 1 is an I-shaped iron core body or a T-shaped iron core body transformed from an I-shaped iron core body. The main iron core body 1, the right side iron core body 3 and the left side iron core body 2 can be made of a ferrite material, or manufactured by other soft magnetic materials in the practical implementation. The assembling surface 31 of the right side iron core body 3 and the assembling surface 21 of the left side iron core body 2 respectively correspond to the right side assembling plane 13 and the left side assembling plane 14 formed at the two sides of the main iron core body 1.

The plurality of metal sheet coils include a right side metal sheet coil 5 and a left side metal sheet coil 4, and the right side metal sheet coil 5 and the left side metal sheet coil 4 both can be a N-shaped or a C-shaped metal sheet coil. In practice, the right side metal sheet coil 5 and the left side metal sheet coil 4 can be formed by stamping general copper sheets or by using other conductive materials, but the present disclosure is not limited thereto. The right side metal sheet coil 5 has a crossbeam 51 and the left side metal sheet coil 4 has a crossbeam 41 as shown in FIG. 1. More specifically, both ends of each crossbeam extend outwards and bend downwards to respectively form a vertical plane which is an electrical conductive pin 52, 42. In one implementation, each of the electrical conductive pins 52, 42 is a vertical plane extending downwards to be used as a pin, and can further exceed the bottom surface 16 of the main iron core body 1 to raise the entire height of the none-coupling dual inductor. In another implementation, after extending downwards, each of the electrical conductive pins 52, 42 is bent again to form a C-shaped pin, but the present disclosure is not limited thereto.

The plurality of plate bodies include the right side plate body 7 and the left side plate body 6. In practice, the plate bodies can be made of different non-ferromagnetic materials, which is to achieve air gaps between the main iron core body 1 and the right side iron core body 3 and between the main iron core body 1 and the left side iron core body 2, that is, the air gaps between the first inductor and the second inductor. In a practical implementation, the right side plate body 7 and the left side plate body 6 are made of non-ferromagnetic materials such as a mylar film, a kraft paper, a plastic sheet, a glass sheet or a mixture of non-ferromagnetic materials. In addition, the air gap can be formed in other manners, such as separating two iron cores.

The assembly of the none-coupling dual inductor of the present disclosure is described as follows.

Figure 2:
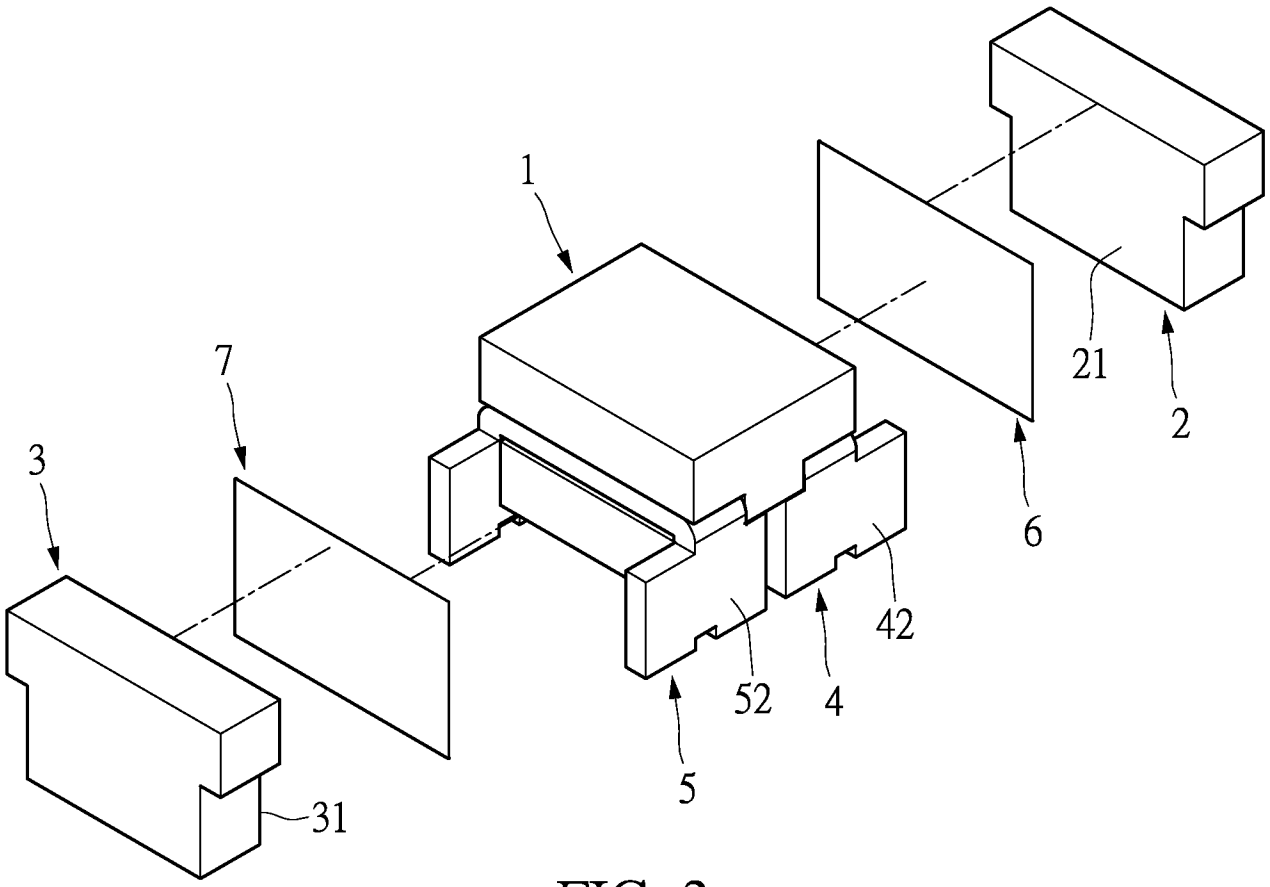
FIG. 2 is an assembly drawing illustrating a part of an embodiment of the present disclosure.

The assembly of the main iron core body 1, the plurality of subsidiary iron core bodies (i.e. the right side iron core body 3 and the left side iron core body 2), the plurality of metal sheet coils (i.e. the right side metal sheet coil 5 and the left side metal sheet coil 4) and the plurality of plate bodies (i.e. the right side plate body 7 and the left side plate body 6) will be described as follows. The crossbeams 51, 41 respectively disposed on the right side metal sheet coil 5 and the left side metal sheet coil 4 are connected with the main iron core body 1. In other words, the crossbeam 51 of the right side metal sheet coil 5 is installed in the right side accommodating space 11 of the main iron core body 1 and the crossbeam 41 of the left side metal sheet coil 4 is installed in the left side accommodating space 12 of the main iron core body 1. Reference is made to FIG. 2, which shows the connection of the main iron core body 1, the right side metal sheet coil 5 and the left side metal sheet coil 4.

On the other hand, the assembly of the main iron core body 1 and the right side iron core body 3 and the left side iron core body 2 means that the assembling surface 31 of the right side iron core body 3 is connected with the right side assembling plane 13 of the main iron core body 1 and the assembling surface 21 of the left side iron core body 2 is connected with the left side assembling plane 14 of the main iron core body 1. The right side plate body 7 is disposed between the right side of the main iron core body 1 and the right side iron core body 3, and sticks to the right side assembling plane 13 of the main iron core body 1 by gluing or other gluing manners. Similarly, the left side plate body 6 is disposed between the left side of the main iron core body 1 and the left side iron core body 2, and sticks to the left side assembling plane 14 of the main iron core body 1 by gluing or other gluing manners.

Figure 3:
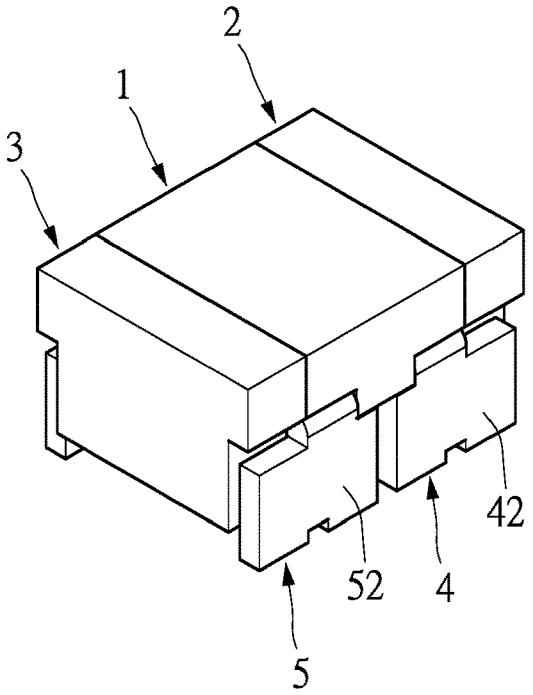
FIG. 3 is a perspective drawing of an embodiment of the present disclosure.
Figure 4:
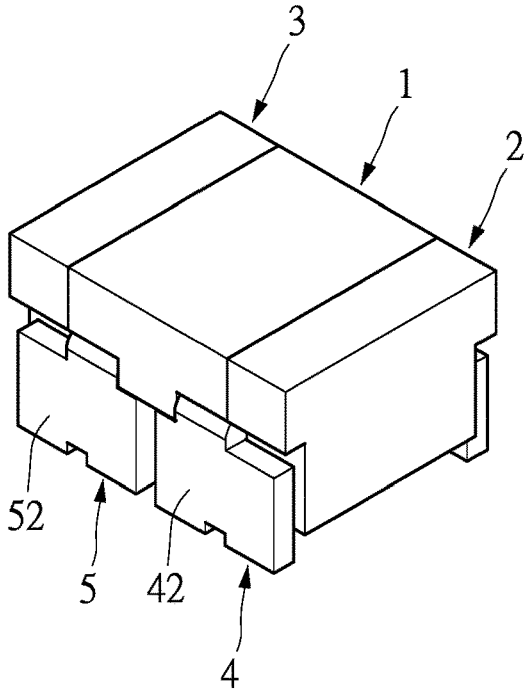
FIG. 4 is a perspective drawing from another angle of an embodiment of the present disclosure.

As mentioned above, the main iron core body 1, the left side iron core body 2, the right side iron core body 3, the left side metal sheet coil 4 and the right side metal sheet coil 5 are combined together to form an integral device or an integral element which has a special magnetic circuit structure. After the combination, the none-coupling dual inductor provided by the present disclosure can be referred to FIG. 3 and FIG. 4. The middle bump 15 and the left side accommodating space 12 of the main iron core body 1 (i.e. the I-shaped main iron core body) are combined with the left side metal sheet coil 4, the left side iron core body 2 and the left side plate body 6 to form the first inductor. Similarly, the middle bump 15 and the right side accommodating space 11 of the main iron core body 1 (i.e. the I-shaped main iron core body) are combined with the right side metal sheet coil 5, the right side iron core body 3 and the right side plate body 7 to form the second inductor. The first inductor and the second inductor are formed as an integral device, so that the dual inductor can control air gaps between the iron core bodies through the left side plate body 6 and the right side plate body 7 to obtain the same inductance or different inductances according to user requirements.

Because the first inductor and the second inductor of the none-coupling dual inductor of the present disclosure share the middle bump 15 of the main iron core body 1, the two inductors can be formed integrally to effectively decrease the number of elements disposed on the printed circuit board. On the other hand, by sharing the middle bump 15 of the main iron core body 1, the entire size and space of the present disclosure can be reduced to the most extent so as to increase the power density, as well as minimizing the device.

The magnetic circuit of the none-coupling dual inductor of the present disclosure is described as follows.

Figure 5:
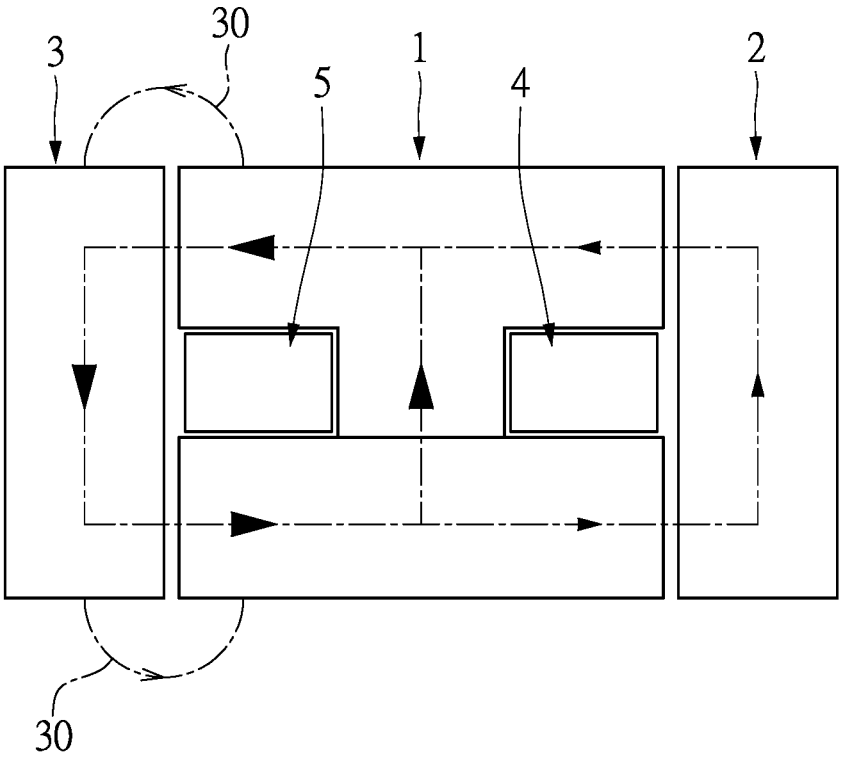
FIG. 5 is a schematic diagram of the magnetic flux of an embodiment of the present disclosure.
Figure 6:
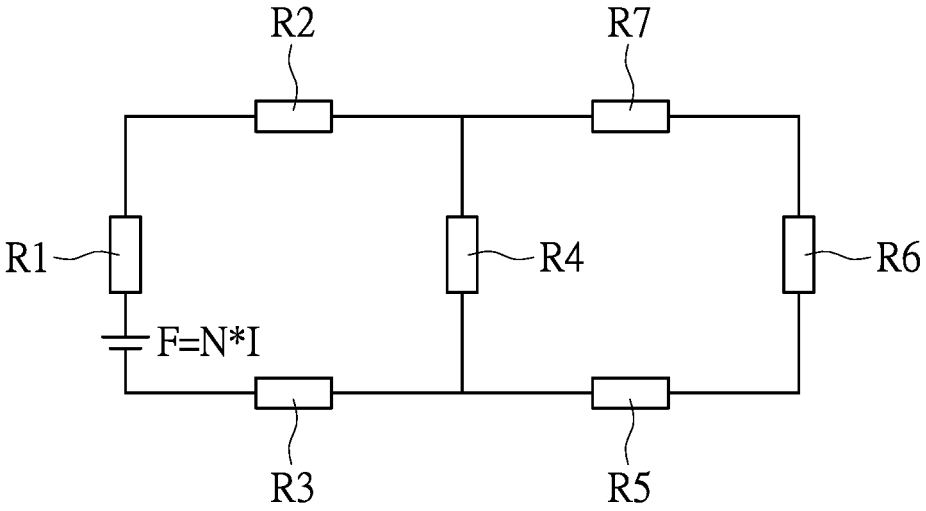
FIG. 6 is a schematic diagram of the magnetic resistance route of an embodiment of the present disclosure.

By means of the special magnetic circuit structure provided by the present disclosure, the technical effectiveness of none-coupling dual inductor can be achieved. Reference is made to FIG. 5 and FIG. 6. When the right side metal sheet coil 5 works, the magnetic flux path can be referred to FIG. 5. When a total of magnetomotive force of the magnetic circuit is F=N*1, wherein F is magnetomotive force, N is turn number and I is exciting current, the equivalent magnetic circuit can be referred to FIG. 6. Because the magnetic permeability of the magnetic core in the iron core body is far greater than the magnetic permeability in air, the magnetic resistances R2, R3, R5 and R7 having air gaps are far greater than the magnetic resistances R1, R4 and R6. Like currents, the magnetic flux flows in the magnetic circuit having low magnetic resistance, and the magnetic circuit having high magnetic resistance has small magnetic flux. Consequently, it can be found that after the magnetic resistances R5, R6 and R7 connect in series, they are in parallel connection with the magnetic resistance R4 in the equivalent magnetic circuit driven by the magnetomotive force F=N*I, and thus the magnetic flux in the bypass of the magnetic resistances R5, R6 and R7 is close to zero. That is to say, when the right side metal sheet coil 5 has the magnetomotive force F=N*I which can excite the magnetic potential, the coupling degree of the left side metal sheet coil 4 is relatively low.

In terms of the leakage magnetic flux of an inductor, the inductor having air gaps would produce leakage magnetic flux 30 around the air gaps, and the leakage magnetic flux 30 is one of the reasons of causing coupling between a dual inductor. In the present disclosure, the distance between the air gaps is relative farther, so that compared with conventional inductors which are not an I-shaped or a C-shaped inductor, the present disclosure can avoid the coupling caused by the leakage magnetic flux between the dual inductor to the utmost extent, so as to effectively achieve a low coupling coefficient.

It has to be addressed that the none-coupling dual inductor of the present disclosure employs the thickness of the right side plate body 7 and the left side plate body 6 to control the air gaps between the inductors to obtain the desired inductance, wherein the respective inductances of the first inductor and the second inductor can be the same or different from each other and is controlled through the thickness of the right side plate body 7 and the left side plate body 6. In addition, the direct current resistance of the first inductor and the second inductor is decided by the right side metal sheet coil 5 and the left right sheet coil 4, wherein the respective direct current resistances of the first inductor and the second inductor can be the same or different from each other. Moreover, by means of the electrical conductive pins 52, 42 which respectively extend and exceed the bottom surface 16 of the main iron core body 1 to raise the entire height of the none-coupling dual inductor, other elements can be disposed at the bottom of the none-coupling dual inductor of the present disclosure to further save space of the printed circuit board and increase the power density.

In summary, the none-coupling dual inductor of the present disclosure is capable of improving conventional single inductors and general dual inductors to significantly enhance the inductive characteristics. In addition, the present disclosure also effectively reduces size and saves space, so it does possess the industrial applicability and can satisfy the industrial needs.

The above-mentioned descriptions represent merely the exemplary embodiment of the present disclosure, without any intention to limit the scope of the present disclosure thereto. Various equivalent changes, alterations or modifications based on the claims of the present disclosure are all consequently viewed as being embraced by the scope of the present disclosure.

What is claimed is:

1. A none-coupling dual inductor, comprising:

a main iron core body having an upper iron core body, a lower iron core body, a right side accommodating space, a left side accommodating space and a middle bump; the middle bump is between the upper iron core body and the lower iron core body; the right side accommodating space is formed by the right side of the middle bump, the upper iron core body and the lower iron core body; the left side accommodating space is formed by the left side of the middle bump, the upper iron core body and the lower iron core body;

a plurality of subsidiary iron core bodies respectively disposed corresponding to two sides of the main iron core body;

a plurality of metal sheet coils respectively disposed between the two sides of the main iron core body and the plurality of subsidiary iron core bodies; the plurality of metal sheet coils comprise a right side metal sheet coil and a left side metal sheet coil, and the right side metal sheet coil and the left side metal sheet coil are respectively provided with a crossbeam; and a plurality of plate bodies respectively disposed between the main iron core body and the plurality of metal sheet coils and the plurality of subsidiary iron core bodies;

wherein the middle bump of the main iron core body is connected to the plurality of subsidiary iron core bodies and the plurality of metal sheet coils respectively disposed at the two sides of the main iron core body to form a first inductor and a second inductor, and the plurality of plate bodies control air gaps between the main iron core body and the plurality of subsidiary iron core bodies to obtain the inductances of the first inductor and the second inductor;

wherein the crossbeam of the right side metal sheet coil is installed in the right side accommodating space and the crossbeam of the left side metal sheet coil is installed in the left side accommodating space.

2. The none-coupling dual inductor according to claim 1, wherein the main iron core body is an I-shaped iron core body.

3. The none-coupling dual inductor according to claim 2, wherein the plurality of subsidiary iron core bodies comprise a right side iron core body and a left side iron core body, and the right side iron core body and the left side iron core body are an I-shaped iron core body or a T-shaped iron core body transformed from an I-shaped iron core body.

4. The none-coupling dual inductor according to claim 3, wherein the main iron core body comprises a right side assembling plane and a left side assembling plane; the right side iron core body and the left side iron core body respectively have an assembling surface; the assembling surface of the right side iron core body is connected with the right side assembling plane of the main iron core body, and the assembling surface of the left side iron core body is connected with the left side assembling plane of the main iron core body.

5. The none-coupling dual inductor according to claim 3, wherein the plurality of plate bodies comprises a right side plate body and a left side plate body, the right side plate body is disposed between the right side of the main iron core body and the right side iron core body, and the left side plate body is disposed between the left side of the main iron core body and the left side iron core body.

6. The none-coupling dual inductor according to claim 3, wherein the main iron core body, the right side iron core body and the left side iron core body are made of a ferrite material or a soft magnetic material.

7. The none-coupling dual inductor according to claim 1, wherein the right side metal sheet coil and the left side metal sheet coil are formed by stamping copper sheets.

8. The none-coupling dual inductor according to claim 1, wherein both ends of each crossbeam of the right side metal sheet coil and the left side metal sheet coil extend outwards and bend downwards to respectively form a vertical plane which is an electrical conductive pin, and each electrical conductive pin extends and exceeds the bottom surface of the main iron core body to raise the entire height of the none-coupling dual inductor.

9. The none-coupling dual inductor according to claim 5, wherein the right side plate body and the left side plate body are made of non-ferromagnetic materials including a mylar film, a kraft paper, a plastic sheet, a glass sheet or a mixture of non-ferromagnetic materials.

* * * * *